US006082495A

United States Patent [19]

Steinbarger et al.

[11] Patent Number: 6,082,495

[45] Date of Patent: Jul. 4, 2000

[54] SCROLL COMPRESSOR BEARING LUBRICATION

[75] Inventors: David L. Steinbarger, Sidney; Aelred F. Pereira, Troy, both of Ohio

[73] Assignee: Copeland Corporation, Sidney, Ohio

[21] Appl. No.: 09/030,401

[22] Filed: Feb. 25, 1998

[51] Int. Cl.[7] ..... F16N 15/00

[52] U.S. Cl. ..... 184/99; 184/6.16; 384/102; 384/290; 384/624; 417/DIG. 1; 418/55.6; 29/898.1

[58] Field of Search ..... 184/6.16, 6.21, 184/6.22, 99, 98; 384/624, 102, 290; 417/DIG. 1, 310, 902, 366; 418/55.5, 57, 55.6; 29/898.1, 898.055

[56] References Cited

U.S. PATENT DOCUMENTS

| | | | |
|---|---|---|---|
| 3,590,957 | 7/1971 | Campbell | 184/99 |
| 3,818,564 | 6/1974 | Tsuya et al. | 29/149.5 |
| 4,657,687 | 4/1987 | Caporiccio et al. . | |
| 4,674,164 | 6/1987 | McCloskey | 29/149.5 B |
| 4,958,993 | 9/1990 | Fujio | 418/55.3 |
| 5,364,248 | 11/1994 | Nakashima | 418/178 |
| 5,490,730 | 2/1996 | Akita et al. . | |
| 5,511,959 | 4/1996 | Tojo et al. | 418/55.1 |
| 5,584,678 | 12/1996 | Hirooka et al. | 418/55.2 |

OTHER PUBLICATIONS

V. D'agostino et al., Tribological behaviour of sintered iron bearings self–lubricated with PFPE under severe operating conditions, Apr., 1998, vol. 21, No. 2, pp. 105–110.

*Primary Examiner*—David M. Fenstermacher
*Attorney, Agent, or Firm*—Harness, Dickey & Pierce, P.L.C.

[57] ABSTRACT

A scroll-type machine is disclosed which incorporates a lubricant impregnated drive bushing. The lubricant utilized for the impregnation process will preferably be of a type which is insoluble in the fluid being handled by the scroll-type machine, will remain trapped in the pores of the drive bushing under normal operating temperatures as well as any temperatures encountered during manufacturing processes to which the assembled compressor may be subjected yet will wick out of the bushing when its temperature increases such as may occur when insufficient lubricant is being supplied thereto by the normal lubrication system.

14 Claims, 3 Drawing Sheets

SCROLL COMPRESSOR BEARING LUBRICATION

BACKGROUND AND SUMMARY OF THE INVENTION

The present invention relates generally to scroll-type machinery. More particularly, the present invention relates to a scroll-type machine incorporating a drive bushing which is impregnated with a lubricant designed to be released under predetermined conditions.

A class of machines exists in the art generally known as "scroll" apparatus for the displacement of various types of fluids. Such apparatus may be configured as an expander, a displacement engine, a pump, a compressor, etc., and the features of the present invention are applicable to any one of these machines. For purposes of illustration, however, the present invention is disclosed incorporated into a hermetic refrigerant compressor.

Generally speaking, a scroll apparatus comprises two similar scroll members each of which includes a spiral scroll wrap upstanding from an end plate. The two scroll members are interfitted together with one of the scroll wraps being rotationally displaced approximately 180 degrees from the other. The scroll apparatus operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation, i.e., the motion is purely curvilinear translation or orbital. The fluid pockets carry the fluid to be handled from a first zone in the scroll apparatus wherein a fluid inlet is provided, to a second zone in the scroll apparatus where a fluid outlet is provided. The volume of a sealed pocket changes as it moves from the first zone to the second zone. At any one instant in time, there will be at least one pair of sealed pockets, and when there are several pairs of sealed pockets at one time, each pair will have different volumes. In a compressor, the second zone is at a higher pressure than the first zone and is physically located centrally in the scroll apparatus, the first zone being located at the outer periphery of the scroll apparatus.

The concept of a scroll-type apparatus has thus been known for some time and has been recognized as having distinct advantages. For example, scroll machines have high isentropic and volumetric efficiency, and hence are relatively small and lightweight for a given capacity. They are quieter and more vibration free than many compressors because they do not use large reciprocating components (e.g. pistons, connecting rods, etc.) and because all of the fluid flow is in one direction with simultaneous compression in plural opposed pockets, there are less pressure-created vibrations. Such machines also tend to have high reliability and durability because of the relatively few moving parts utilized, the relative low velocity of movement between the scroll, and an inherent forgiveness to fluid contamination.

In one popular orbiting scroll compressor, a drive shaft is provided being rotatably supported by upper and lower bearings and has an eccentric pin drivingly coupled to the orbiting scroll member via a drive bushing. The drive bushing is rotatably disposed within a hub provided on the orbiting scroll and includes a slightly oval bore having a flat therein which allows for a generally radially directed sliding engagement between it and a corresponding flat on the eccentric drive shaft pin. This sliding engagement provides a radial compliance to the scroll compressor.

In order to lubricate the upper and lower bearings as well as the inside and outside surfaces of the bushing an oil sump is provided in the lower portion of a shell in which the compressor is disposed. The lower end of the drive shaft extends into this sump and includes an oil pump and a radially offset axially extending passage through which oil is supplied to the bearings and bushing.

Under certain flooded start circumstances, it has been discovered that a major portion of the lubricant from the sump may be discharged from the compressor to the air conditioning system of which the compressor forms a part along with the refrigerant. Because in such so-called split systems the compressor and condenser are typically located outside the building and the evaporator is located at some distance therefrom inside the building, a substantial time period may elapse before the discharged lubricant or oil is returned to the compressor. This time period may be as much as 6–10 minutes or even longer during which time the oil pump is unable to supply lubricant to the bearings and bushing. As a result the bearings and bushing will be running dry. This dry running will result in heating as well as wear of the bearings and bushing. The drive bushing is believed to be the most sensitive to such lubrication deficiencies perhaps because it is less able to dissipate heat to its surrounding structure (i.e. its position in the hub of the orbiting scroll which is also subject to heating by the compression process) and it will be the last bearing surface to receive lubricant once the supply has been replenished.

Compounding the problem is that in highly charged split heat pump systems which are installed during periods when substantial fluctuations in temperature are encountered and the system is not operated for an extended period of time, it is believed a strong reflux action occurs. This reflux action results in migration and cyclical condensation and vaporization of refrigerant in the compressor shell during these temperature swings. This cyclical condensation and vaporization of the refrigerant results in a washing action on the bearings tending to wash away any residual lubricant.

The present invention seeks to overcome this problem by providing a drive bushing which is impregnated with a suitable lubricant designed to be released therefrom during such periods of dry running. The ability to supply even a minimal amount of lubricant to the bearing surfaces of the drive bushing during the above described periods of insufficient lubricant supply will greatly reduce the potential for damage and/or premature failure of the sensitive drive bushing and hence prolong the operating life of the compressor.

Additional advantages and features of the present invention will become apparent from the subsequent description and the appended claims taken in conjunction with the accompanying drawings.

DESCRIPTION OF THE PREFERRED EMBODIMENT

The present invention is suitable for incorporation in many different types of scroll machines. For exemplary purposes it will be described herein incorporated into a hermetic scroll refrigerant motor compressor of the type where the motor and the compressor are cooled by the suction gas within the hermetic shell as illustrated in the vertical section shown in FIG. 1.

Figure 1:
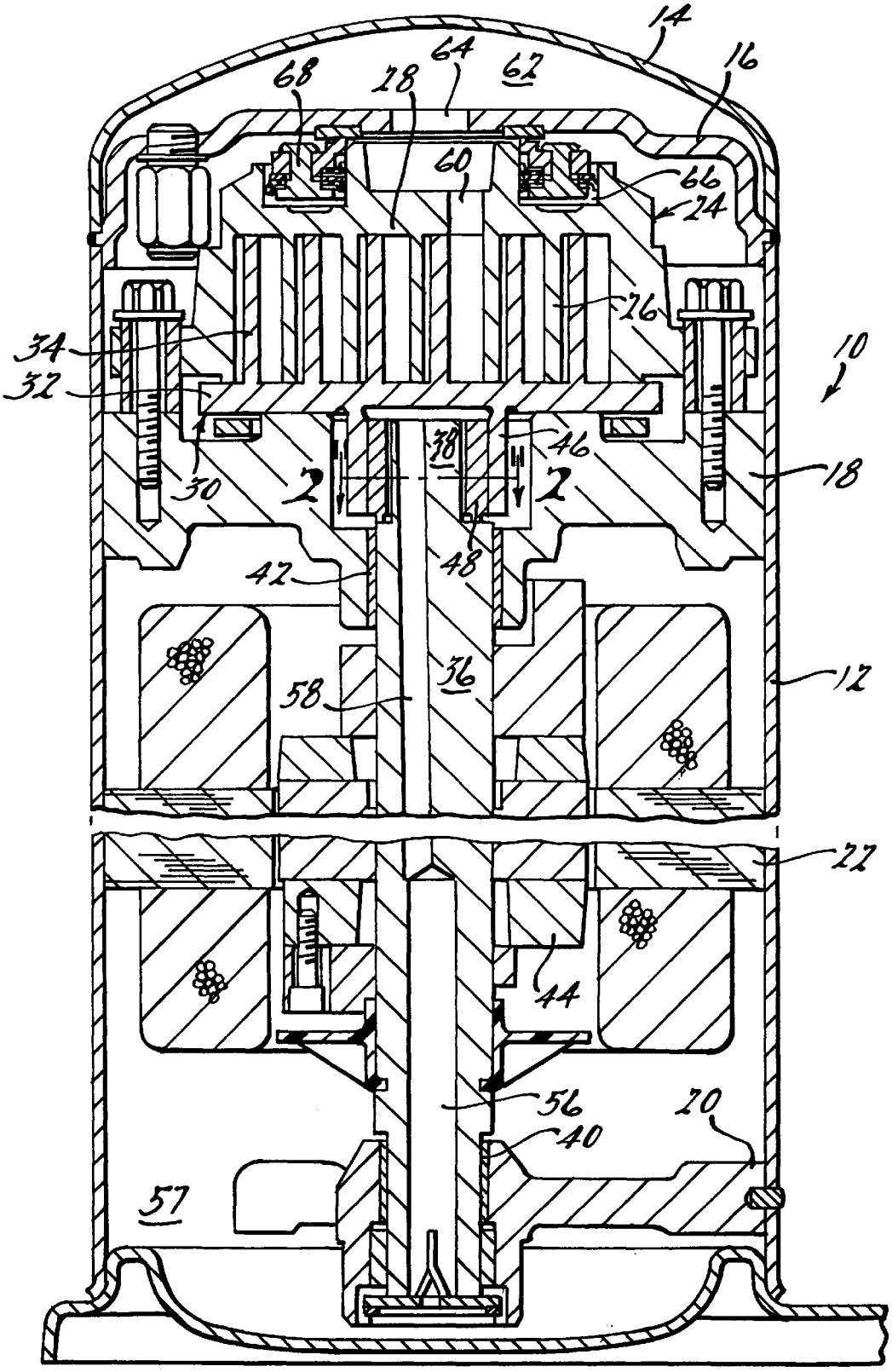
FIG. 1 is a section view of a scroll compressor in accordance with the present invention, the section being taken along a vertical plane passing through the axis of rotation of the drive shaft.

Referring now to the drawings in which like reference numerals designate like or corresponding parts throughout the several views, there is shown in FIG. 1, a scroll compressor 10 incorporating a drive bushing in accordance with the present invention. Compressor 10 comprises a cylindrical hermetic shell 12 having welded at the upper end thereof a cap 14. Cap 14 is provided with a refrigerant discharge fitting optionally having the usual discharge valve therein (not shown). Other elements affixed to cylindrical shell 12 include a transversely extending partition 16 which is welded about its periphery at the same point cap 14 is welded to shell 12, a main bearing housing 18 and a lower bearing housing 20 both of which are affixed to shell 12 at a plurality of points by methods well known in the art, and a suction gas inlet fitting (not shown). A motor stator 22 is also supported by shell 12 being positioned between upper and lower bearing housings 18 and 20.

A non-orbiting scroll member 24 is axially movably secured to main bearing housing 18 and includes a spiral wrap 26 depending from an end plate portion 28. An orbiting scroll member 30 is also movably supported by main bearing housing 18 and includes an end plate 32 from which a spiral wrap 34 extends upwardly. Wraps 26 and 34 are interleaved with each other such that as orbiting scroll member 30 orbits with respect to non-orbiting scroll member 24, wraps 26 and 34 will define moving fluid pockets which decrease in volume as they move from a radially outer position to a radially inner position.

In order to orbit orbiting scroll member 30, a crankshaft 36 having an eccentric crank pin 38 at the upper end thereof is rotatably journalled in bearing 40 in lower bearing housing 20 and in a bearing 42 located in main bearing housing 18. A motor rotor 44 is secured to crankshaft 36 and cooperates with stator 22 to rotatably drive crankshaft 36.

Figure 2:
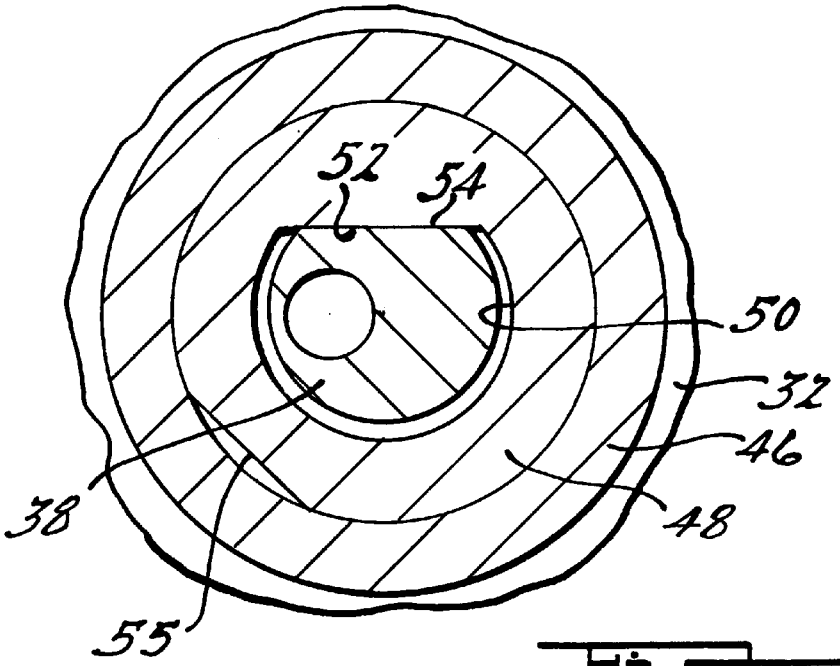
FIG. 2 is a section view of the drive arrangement shown in FIG. 1, the section being taken along line 2—2 thereof.
Figure 3:
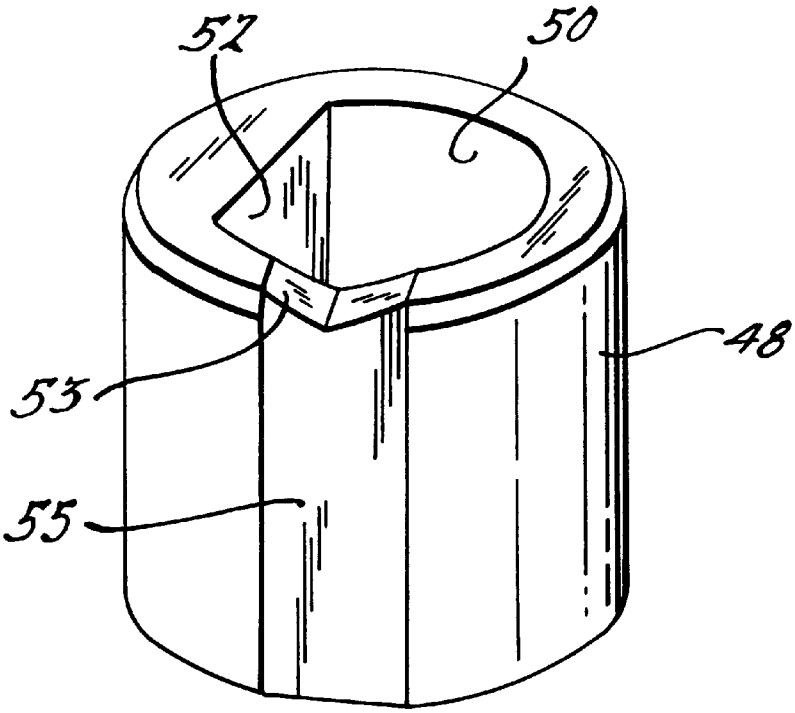
FIG. 3 is a perspective view of the drive bushing utilized in the compressor of FIG. 1.

Orbiting scroll member 30 includes a cylindrical hub 46 extending downwardly from end plate 32 within which is rotatably disposed a bushing 48. As best seen with reference to FIGS. 2 and 3, bushing 48 has a bore 50 extending therethrough within which drive pin 38 is received. Bore 50 is generally oval in shape and includes a flat 52 which slidingly engages a flat 54 provided on drive pin 38 to thereby accommodate radial movement of orbiting scroll member 30. Bushing 48 is preferably fabricated from a suitable powdered metal material. In order to aid in directing lubricant to the outer surfaces of bushing 48, a radially extending generally V-shaped notch 53 is provided at the upper end thereof which communicates with a flat 55 provided on the outer peripheral surface thereof. Preferably notch 53 and flat 55 will be positioned so as to be trailing the direction of rotation of driving and driven flats 54 and 52.

In order to provide lubrication to bearings 40 and 42 as well as bushing 48, crankshaft 36 has at its lower end the usual relatively large diameter oil pumping concentric bore 56 which communicates with a smaller diameter radially offset bore 58 extending upward therefrom to the top of crankshaft 36. The lower portion of cylindrical shell 12 defines an oil sump 57 which is filled with lubricating oil in the usual manner and the pump at the bottom of crankshaft 36 is the primary pump acting in conjunction with bore 58 to pump lubricating fluid to all the various components of compressor 10 which require lubrication. As noted above, notch 53 and flat 55 will be positioned in a trailing relationship to the direction of rotation of flats 52 and 54. Thus notch 53 will facilitate a portion of the oil thrown out of the upper end of bore 58 being directed to the outer surface of bushing 48 while flat 55 will aid in its distribution over the entire axial length thereof. The remaining oil being discharged from bore 58 will serve to lubricate the surfaces of bore 58 including flats 52 and 54.

In operation, suction gas entering shell 12 through the suction fitting will be drawn into a compression pocket being formed between the wraps 34 and 26 on the orbiting and non-orbiting scroll members. As the orbiting scroll member 30 continues to orbit, the compression pocket will be sealed off by interengaging flank surfaces of the wraps and will progressively move spirally radially inwardly decreasing in volume and hence compressing the gas contained therein. The compressed fluid is then discharged via discharge port 60 into a discharge chamber 62 via opening 64 provided in partition 16.

In order to ensure sealing engagement between the ends or tips of the wraps and the opposed end plate, non-orbiting scroll is provided with an annular recess 66 within which a floating seal 68 is disposed. Fluid at a pressure between suction and discharge pressure is admitted into recess 60 from the moving fluid pockets and acts to axially bias non-orbiting scroll member 24 toward orbiting scroll member 30. Floating seal 68 also sealingly engages partition 16 so as to ensure discharge gas is directed into discharge chamber 56.

As noted above, under certain conditions, the lubricant supply in the sump 57 may be depleted on start up such that the oil pump is unable to supply sufficient lubricant to the bushing and possibly the bearing surfaces as well. The drive bushing tends to be the most sensitive component to such dry running conditions which conditions may cause excessive heat and wear and possibly even premature failure in extreme situations.

In order to overcome this problem, the bushing of the present invention is impregnated with a suitable lubricant which is designed to wick to the surface in response to an increase in temperature of the bushing which occurs during the aforementioned dry running conditions. Preferably, the lubricant used to impregnate bushing will not be soluble in the refrigerant so as to prevent it from being washed away due to the cyclical vaporization and reflux action to which the compressor may be subjected. It may also be desirable that the lubricant be resistant to being washed out by the lubricating oil contained in the sump. Additionally, the lubricant must be sufficiently viscous so as to remain trapped within the pores of the bushing both during normal operating conditions as well as when the compressor is passed through the dehydrating oven during manufacturing thereof. These dehydrating ovens typically operate at a temperature of about 300 degrees F. Further, the lubricant should become sufficiently fluid upon heating of the bushing from dry running to wick to the surface to thereby provide some lubrication during this dry running period. It is believed preferable for the lubricant to begin wicking out of the bushing at temperatures in the range of approximately 350°–400° F. It is also preferred that the impregnated lubricant provide sufficient lubrication to the bushing to ensure operation of the compressor for a sufficient time period to enable the lubricant discharged into the system to return to the compressor so that full lubrication can be restored. While this time period will vary between systems depending primarily on the distance between the system components, it is believed that a minimum time period of 10 minutes is preferred.

For both hydrochloroflurocarbon (HCFC) and hydroflurocarbon (HFC) refrigerants, polyalphaolefin (PAO) oils having ISO viscosities of 220 or higher have been found to provide excellent results. It should be noted that while the above mentioned lubricants provide satisfactory results, there may well be other lubricants that have the desired characteristics set forth above to provide satisfactory results. Ideally, it is desirable to utilize a single lubricant which is insoluble in both HCFC and HCF refrigerants and has the desired viscosity levels. This eliminates the need to separately process and inventory two types of impregnated bushings as well as eliminating the possibility of the wrong impregnated bushing being utilized in a compressor.

Bushing 48 may be impregnated by either a vacuum process or by a hot soaking process.

Figure 4:
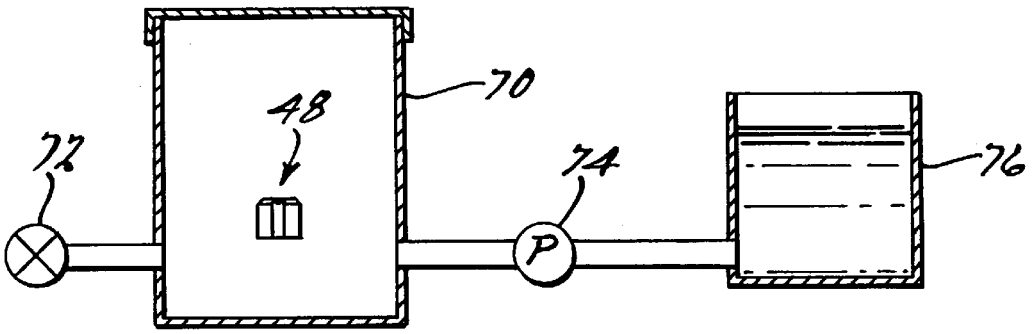
FIG. 4 is a diagrammatic view illustrating one method by which the drive bushing may be impregnated with lubricant in accordance with the present invention.

As shown in FIG. 4, in the vacuum process, the bushing 48 is first placed in a container 70 which is then sealed and a partial vacuum is drawn by vacuum pump 72. Preferably pump 72 will reduce the pressure to at least about 1.38 psi absolute at which pressure the bushing 48 will be held for a period of three hours. Thereafter, pump 74 will operate to supply lubricant to container 70 and bushing 48 from supply 76 and pressurize same. Preferably bushing 48 will remain in the pressurized lubricant for a period of about 2 hours at a pressure of about 5000 psi absolute.

Figure 5:
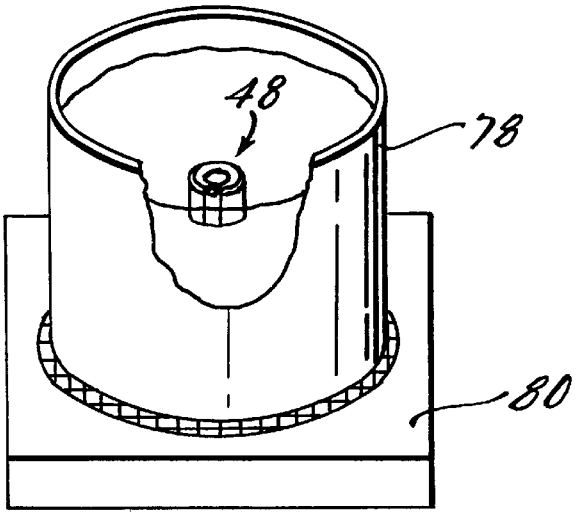
FIGS. 5–7 diagrammatically show another method by which the drive bushing may be impregnated with lubricant, all in accordance with the present invention.
Figure 6:
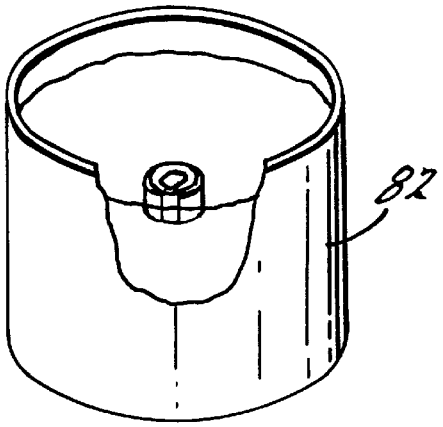
Figure 7:
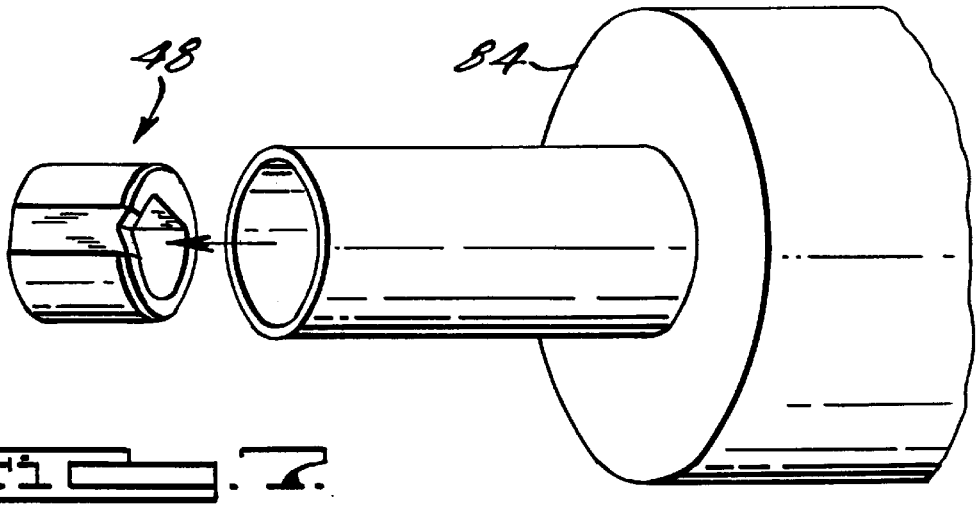

In the hot soaking process illustrated in FIGS. 5–7, lubricant disposed within container 78 is heated by heater 80 to a temperature which, for the above referenced PAO lubricants utilized for HCFC and HFC refrigerants is in the range of 350°–425° F. Bushing 48 is then immersed in the heated lubricant and allowed to soak for a period of at least five minutes. The hot bushing 48 is thereafter removed from the heated lubricant and immersed in container 82 containing a supply of cold lubricant maintained at a temperature of about 75° F.–150° F. for a period of about five minutes. Thereafter the bushing is removed from the cold bath and the excess lubricant is removed by blowing pressurized air from pressurized air source 84 thereacross as shown in FIG. 7. This hot soaking process is believed preferable as it may be more easily accommodated in the manufacturing process and requires a much shorter processing time.

In any event, the resulting impregnated bushing will have a supply of lubricant trapped in the pores thereof which lubricant will be released when and if needed as a result of increased temperature of the bushing. Because the lubricant is insoluble with the refrigerant being utilized, the vaporization thereof and/or compressor flooding will not result in washing away of the lubricant. Thus the resulting lubricant impregnated bushing will be well suited to resist degradation resulting from periods in which insufficient lubricant is being supplied thereto and the compressor will offer improved reliability even under the unique conditions set forth in the Background and Summary of the Invention above. It should be noted that while a specific lubricant has been specified for HCFC and HFC refrigerants, the same principles set forth herein provide a guideline for the selection of a suitable lubricant for use in scroll-type machines designed to handle other fluids and in which the drive bushing may be subjected to a similar type of washing action and dry running condition or for selection of other lubricants for these types of refrigerants.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A scroll-type machine comprising:

a hermetic shell having an oil sump in a lower portion thereof;

a first scroll member having an end plate and a first spiral wrap upstanding therefrom;

a second scroll member having an end plate and a second spiral wrap upstanding therefrom, said first and second spiral wraps being interleaved to define a plurality of moving fluid pockets of changing volume;

a main bearing housing supported by said shell and having a bearing surface;

a drive shaft rotatably supported by said bearing surface of said main bearing housing;

a bushing provided on one end of said drive shaft, said bushing coupling said drive shaft to said second scroll members wherein said second scroll member is driven in relative orbital movement with respect to said first scroll member;

said drive shaft including an oil pump and passage means for directing oil from said sump to said bearing surface and said bushing;

said bushing being impregnated with a liquid lubricant, said liquid lubricant being operative to lubricate said bushing when the operating temperature of said bushing exceeds a normal operating temperature.

2. A scroll-type machine as set forth in claim 1 wherein said scroll-type machine is designed to cycle a fluid therethrough and said liquid lubricant is substantially insoluble in said fluid.

3. A scroll-type machine as set forth in claim 2 wherein said fluid is selected from the group comprising hydrochloroflurocarbon and hydroflurocarbon refrigerants and said liquid lubricant is a polyalphaolefin oil.

4. A scroll-type machine as set forth in claim 3 wherein said liquid lubricant has an ISO viscosity of at least 220.

5. A scroll-type machine as set forth in claim 2 wherein said bushing is impregnated with said liquid lubricant by a vacuum impregnation process.

6. A scroll-type machine as set forth in claim 2 wherein said bushing is impregnated with said liquid lubricant by a hot soaking process.

7. A scroll-type machine as set forth in claim 2 wherein said luquid lubricant resists wicking out of said bushing under normal operating conditions due to a viscosity of said lubricant.

8. A scroll-type machine comprising:

a hermetic shell having an oil sump in a lower portion thereof;

a first scroll member having an end plate and a first spiral wrap upstanding therefrom;

a second scroll member having an end plate and a second spiral wrap upstanding therefrom, said first and second spiral wraps being interleaved to define a plurality of moving fluid pockets of changing volume;

a main bearing housing supported by said shell and having a bearing surface;

a drive shaft rotatably supported by said bearing surface of said main bearing housing;

a powdered metal bushing provided on one end of said drive shaft, said powdered metal bushing coupling said drive shaft to said second scroll members wherein said second scroll member is driven in relative orbital movement with respect to said first scroll member;

said drive shaft including an oil pump and passage means for directing oil from said sump to said bearing surface and said powdered metal bushing;

said powdered metal bushing being impregnated with a liquid lubricant, said liquid lubricant being operative to lubricate said powdered metal bushing when the operating temperature of said powdered metal bushing exceeds a normal operating temperature.

9. A scroll-type machine as set forth in claim 8 wherein said scroll-type machine is designated to cycle a fluid therethrough and said liquid lubricant is substantially insoluble in said fluid.

10. A scroll-type machine as set forth in claim 9 wherein said fluid is selected from the group comprising hydrochloroflurocarbon and hydroflurocarbon refrigerants and said, liquid lubricant is a polyalphaolefin oil.

11. A scroll-type machine as set forth in claim 10 wherein said liquid lubricant has an ISO viscosity of at least 220.

12. A scroll-type machine as set forth in claim 9 wherein said powdered metal bushing is impregnated with said liquid lubricant by a vacuum impregnated process.

13. A scroll-type machine as set forth in claim 9 wherein said powdered metal bushing is impregnated with said liquid lubricant by a hot soaking process.

14. A scroll-type machine as set forth in claim 9 wherein said liquid lubricant resists wicking out of said powdered metal bushing under normal operating conditions due to a viscosity of said lubricant.

* * * * *

UNITED STATES PATENT AND TRADEMARK OFFICE

CERTIFICATE OF CORRECTION

PATENT NO. : 6,082,495
DATED : July 4, 2000
INVENTOR(S) : David L. Steinbarger et al

It is certified that error appears in the above-identified patent and that said Letters Patent is hereby corrected as shown below:

On the Title Page, under Other Publications, line 3, "1998" should be -- 1988 --.

Column 6, line 51, "luquid" should be -- liquid --.

Column 8, line 3, delete ",".

Signed and Sealed this

First Day of May, 2001

*Attest:*

Nicholas P. Godici

NICHOLAS P. GODICI

*Attesting Officer*

*Acting Director of the United States Patent and Trademark Office*